United States Patent [19]

Harada

[11] Patent Number: 4,518,941

[45] Date of Patent: May 21, 1985

[54] PULSE TRANSFORMER FOR SWITCHING POWER SUPPLIES

[75] Inventor: Hajime Harada, Tokyo, Japan

[73] Assignee: Nihon Kohden Corporation, Tokyo, Japan

[21] Appl. No.: 552,458

[22] Filed: Nov. 16, 1983

[51] Int. Cl.[3] ..... H01F 15/04; H01F 15/15

[52] U.S. Cl. ..... 336/69; 336/84 C; 336/183

[58] Field of Search ..... 336/84 R, 84 C, 69, 336/70, 180, 182, 183, 184

[56] References Cited

U.S. PATENT DOCUMENTS

| | | | |
|---|---|---|---|
| 792,248 | 6/1905 | Campbell | 336/84 C |
| 2,170,048 | 8/1939 | Dunning et al. | 336/84 C X |
| 2,223,737 | 12/1940 | Moses | 336/84 C X |
| 3,265,998 | 8/1966 | Park | 336/84 C X |
| 3,436,704 | 4/1969 | Keto et al. | 336/84 C X |
| 3,675,175 | 7/1972 | Dutton | 336/70 |
| 3,699,488 | 10/1972 | Goodman et al. | 336/84 C |
| 3,717,834 | 2/1973 | Wittich et al. | 336/84 C X |
| 3,845,436 | 10/1974 | Robin | 336/84 C |
| 4,176,334 | 11/1979 | Buritz et al. | 336/84 C |
| 4,333,900 | 6/1982 | Caney | 336/84 C X |

OTHER PUBLICATIONS

1982/83, Power Transistor Handbook, by Nihon Denki Corporation, Japan, pp. 594–605.

*Primary Examiner*—Thomas J. Kozma

*Attorney, Agent, or Firm*—Hoffmann, Dilworth, Barrese & Baron

[57] ABSTRACT

A pulse transformer for use in a switching power supply having primary and secondary windings wound concentrically around a common core and two electrostatic shield foils interposed between the primary and secondary windings with an insulator disposed between the electrostatic shield foils.

1 Claim, 8 Drawing Figures

PULSE TRANSFORMER FOR SWITCHING POWER SUPPLIES

BACKGROUND OF THE INVENTION

The present invention relates to a pulse transformer for use in switching power supplies which transforms a pulsed rectified voltage derived from a commercial power supply system.

FIG. 1 of the accompanying drawings illustrates one example of a switching power supply circuit. A voltage from a commercial power supply is applied through line filters C1, C2, L1, L2, C3 to a full-wave rectifier D1. A rectified voltage from the full-wave rectifier D1 is smoothed by an electrolytic capacitor C4 and then converted by a switching circuit SW1 into high-frequency pulses which are transformed by a transformer T1. A transformed output from the secondary winding of the transformer T1 is rectified by a diode D2 and the rectified voltage is smoothed by a choke L3 and an electrolytic capacitor C5 into a desired DC voltage. Designated at D3 is a flywheel diode for the choke L3, and C6, C7 are line filters. The illustrated circuit arrangement allows the power supply to be small in size and lightweight. However, since the commercial power supply voltage of 100 V or the like is rectified and switched on and off, there are generated high-frequency pulses of one through several hundred volts across the primary winding of the transformer T1 at all times. Accordingly, common-mode noise sources are liable to occur in the primary and secondary windings of the transformer. As shown in FIG. 2, these noise sources are coupled in a voltage-dividing mode by a capacitance between the primary and secondary windings of the transformer T1, and the coupled noise sources serve as a common noise source $e_N$ with respect to ground. The noise is voltage-divided by the input filters L1, L2, C1, C2 and the output filters C6, C7 into primary and secondary common-mode noises which are delivered to the power supply line and the load, respectively. Prevention of these noises from being delivered out requires an increase in the capacitance of the filter capacitors C1, C2, C5, C7 connected to frame ground F.G. As a result, an increased leakage current flows from the power supply through the capacitors C1, C2, with the result that the prior pulse transformer cannot be used particularly in ME (medical electronics) devices as it lacks a required degree of safety.

SUMMARY OF THE INVENTION

Accordingly, it is an object of the present invention to provide a pulse transformer for switching power supplies which is capable of largely reducing noise delivered out without relying on the capacitance of line filter capacitors, particularly applicable to pulse transformers wherein one of the primary and secondary windings is disposed inwardly of the other, and another winding is wound around the other winding and connected parallel to the one winding.

The above object can be basically achieved by interposing two electrostatic shield foils between primary and secondary windings with an insulator disposed bewteen the shield coils. In use, the electrostatic shield coils are connected to points of primary and secondary circuits of the switching power supply where no pulses are produced. With this arrangement, common-mode noises are trapped inside, and the level of the noise source $e_N$ is greatly reduced. Severely considering the winding of the electrostatic shield foils around the core in accordance with the present invention, there is a possibility that an electromotive force of an amplitude corresponding to the number of turns (normally one) of the foils is electromagnetically induced between the leading and trailing ends of the foils. Consequently, when there is a pulsed potential difference between the confronting foils, the differential voltage tends to become a noise source $e_N$ as shown in FIG. 2. To prevent such a new noise source $e_N$ from being produced and trap noise more completely, the primary and secondary electrostatic shield foils are connectable to points of reference voltage in the primary and secondary circuits (where no pulse is generated) through points of the shield foils where induced pulse potentials have the same level with respect to the respective leading ends (beginning ends of winding) of the shield foils serving as points of reference potential. This prevents a pulsed voltage from being induced between the confronting foils, or cancels out any induced voltage throughout the confronting shield foils. Therefore, no new noise source $e_N$ is produced, and noise can more effectively be trapped by the electrostatic shield foils.

With the arrangement of the present invention, the capacitance of the line filter capacitors can be reduced, any leakage current from the power supply lines can be reduced, and the power supply voltage applied to the load through the line filters on the side of the power supply can be reduced at the time the frame ground terminal is disconnected from frame ground.

When the transformer of the foregoing construction is to be used in an actual application, the thickness of the insulator between the primary and secondary windings may be increased to provide a greater dielectric strength and insulating capability. However, the above winding construction allows a pulse transmission loss to be increased and waveshape characteristics to be degraded due to an increased leakage flux.

The present invention relates to a pulse transformer for switching power supplies having better pulse transforming characteristics and a higher dielectric strength capability maintained in suppressing noise delivery to a greater extent. According to the present invention, these objectives are accomplished in a pulse transformer wherein one of the primary and secondary windings is disposed inwardly of the other, by the provision of another winding wound around the primary and secondary windings and connected parallel to one of the primary and secondary windings which is located radially inwardly of the other. This permits the insulator interposed between the electrostatic shield foils to be increased in thickness without degrading the pulse transforming characteristics. The switching power supply incorporating such a pulse transformer can be employed in ME devices which demand strict requirements as to leading current and dielectric strength.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
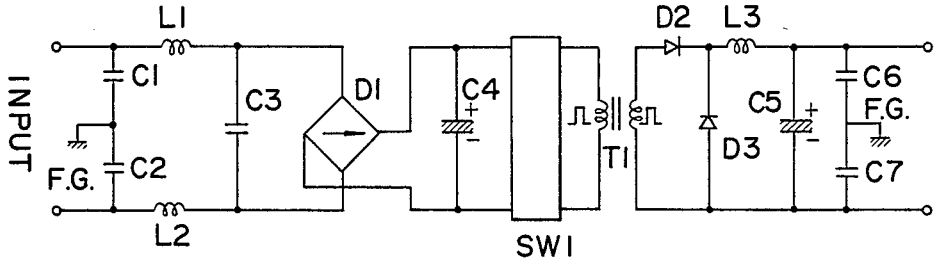
FIG. 1 is a circuit diagram showing a conventional switching power supply.
Figure 2:
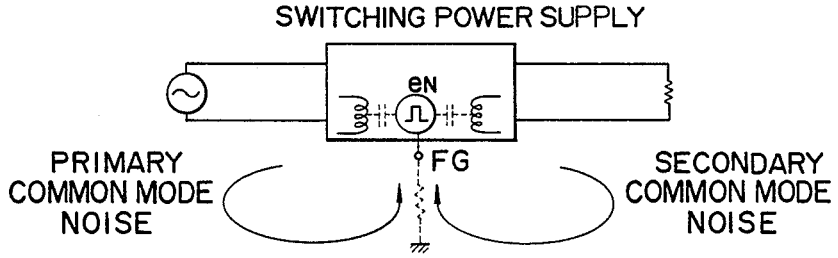
FIG. 2 is a diagram illustrative of the manner in which common mode noises are delivered out of the power supply shown in FIG. 1.
Figure 3:
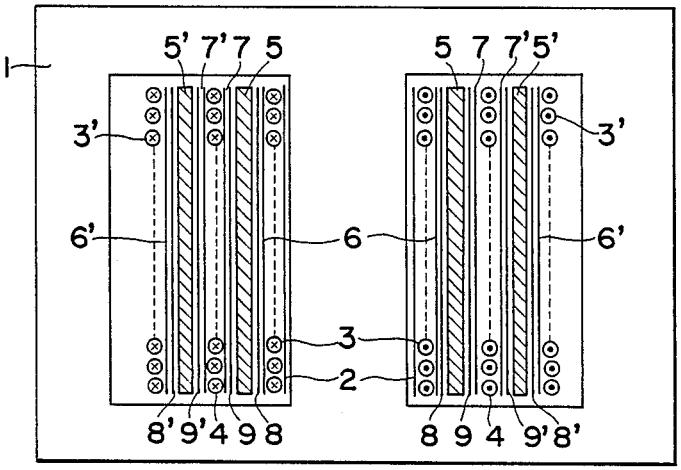
FIG. 3 is a longitudinal cross-sectional view of a pulse transformer for use in a switching power supply according to the present invention.

As shown in FIG. 3, an EI-shaped core 1 has an inner leg on which there is wound a secondary winding 3 with an insulating sheet of paper 2 interposed therebetween. A primary winding 4 is concentrically wound around the secondary winding 3. Between the secondary and primary windings 3, 4, there are interposed and wound a secondary electrostatic shield foil 8 and a primary electrostatic shield foil 9 with an insulator 5 disposed therebetween. Insulating sheets of paper 6, 7 are inserted between the secondary winding 3 and the secondary electrostatic shield foil 8 and between the primary winding 4 and the primary electrostatic shield foil 9, respectively. Another secondary winding 3′ is wound around the primary winding 4. An insulating sheet of paper 7′, a primary electrostatic shield foil 9′, an insulator 5′, a secondary electrostatic shield foil 8′, and an insulating sheet of paper 6′ are sucessively wound and disposed in the order named in a radially outward direction between the windings 4, 3′. The secondary windings 3, 3′ have their leading and trailing ends connected together, thus providing a parallel-connected circuit.

Where the pulse transformer of FIG. 3 is to be used as the transformer shown in FIG. 1, the primary electrostatic shield foils 9, 9′ are connected to a point in the primary circuit in which no pulse is generated, that is, a negative terminal of the electrolytic capacitor C4, for example, and the secondary electrostatic shield foils 8, 8′ are connected to a point in the secondary circuit in which no pulse is produced, for example, a negative terminal of the electrolytic capacitor C5. This wiring arrangement allows any common-mode noise on the primary side to go through the primary winding 4 and the primary electrostatic shield foils 9, 9′ back to the negative terminal of the electrolytic capacitor C4, and to be trapped inside. Likewise, any common-mode noise on the secondary side returns through the secondary electrostatic shield foils 8, 8′ back to the negative terminal of the electrolytic capacitor C5, and is trapped inside. Accordingly, the level of the noise source $e_N$ with respect to ground of the primary and secondary circuits as described with reference to FIG. 2 is greatly reduced. The secondary winding 3 and the primary winding 4 are spaced from each other by the electrostatic shield foils 8, 9 and the insulator 5. This winding construction permits a pulse transmission loss to be increased and hence the waveshape characteristics to be degraded as the leakage flux is increased. With the arrangement of the invention, however, the parallel-connected secondary winding 3′ is disposed around the primary winding 4 with the electrostatic shield foils 9′, 8′ and the insulator 5′ interposed therebetween, causing the leakage flux to pass in an opposite direction between the secondary windings 3, 3′ to thereby reduce a leakage inductance. Stated otherwise, even if the insulators 5, 5′ which provide insulation between the shield foils are increased in thickness for a higher dielectric strength and insulating capability, the common-mode noise can be trapped inside without impairng the efficiency or the pulse waveshape.

Where no higher dielectric strength and insulating property is needed and the insulator 5 is in the form of a foil, the secondary windings may not be connected in parallel. In case the secondary windings are connected in parallel, they may be sandwiched by the primary winding. The core 1 may be in the form of a pot instead of the EI shape.

Figure 4:
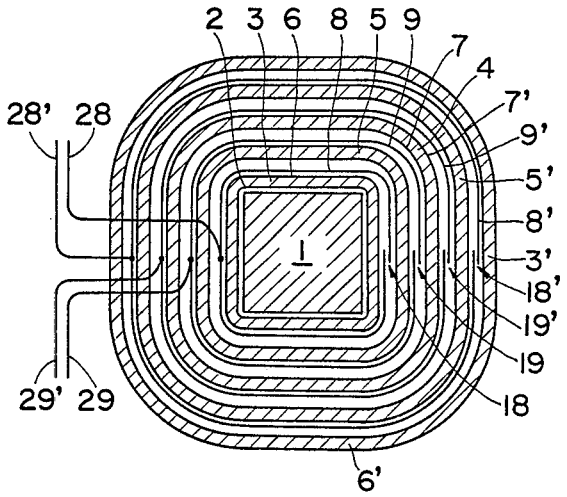
FIG. 4 is a transverse cross-sectional view of a pulse transformer according to another embodiment of the present invention.

FIG. 4 is illustrative of another embodiment of the present invention. Like or identical parts in FIG. 4 are denoted by like or identical reference characters in FIG. 3. A pulse transformer has electrostatic shield foils 8, 8′, 9, 9′ have leading and trailing ends 18, 18′, 19, 19′ aligned in a direction normal to the direction in which the shield foils are wound around the inner leg 1. The leading and trailing ends have overlapping portions electrically insulated from each other by insulating sheets of paper (not shown). To the electrostatic shield foils 8, 8′, 9, 9′, there are soldered connecting wires 28, 28′, 29, 29′ at a radially alined position, which are drawn out of the transformer.

Where the pulse transformer of the above construction is to be used as the transformer T1 of FIG. 1, the connecting wires 29, 29′ are joined to the negative terminal of the capacitor C4 in which no pulse is produced in the primary circuit, and the connecting wires 28, 28′ are likewise connected to the negative terminal of the capacitor C5 in which no pulse is produced in the secondary circuit. This wiring arrangement greatly reduces the level of the noise source $e_N$ with respect to ground of the primary and secondary circuits as described with reference to FIG. 2, and allows pulsed electromotive forces to be cancelled out by each other which are induced in the electrostatic shield foils 8, 8′, 9, 9′ and each correspond to one coil turn. More specifically, since the electrostatic shield coils 8, 8′, 9, 8′ are connected through radially aligned points to the primary and secondary circuits, any voltages of pulses induced across the confront foils 8, 9 or 8′, 9′ with respect to the reference voltage are equalized to each other though they vary with the number of the turns of the foils. No potential difference is generated between the confronting foils in any position in which the foils are wound, and hence the noise source $e_N$ is prevented from being newly produced.

Figure 5:
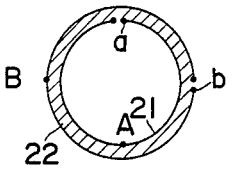
FIG. 5 is a cross-sectional view of shield foils according to still another embodiment.
Figure 6:
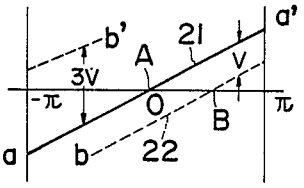
FIG. 6 is a schematic diagram showing the shield foils of FIG. 5.

FIGS. 5 and 6 show the principles of still another embodiment in which a connecting wire is drawn from a primary electrostatic shield foil 21 at a position A, and a connecting wire is drawn from a secondary electrostatic shield foil 22 at a position B. The position B is angularly spaced from the position A by the same angular interval as that by which leading ends a, b of the shield foils 21, 22 are angularly spaced. Consequently, the positions A, B as seen from the leading ends of the foils 21, 22 are the same points of producing pulsed electromotive forces. FIG. 6 illustrates a pulsed electromotive force (indicated by the solid line) induced by the primary electrostatic shield foil 21, and a pulsed electromotive force (indicated by the dotted lines) induced by the secondary electrostatic shield foil 22. A relative pulsed electromotive force v is produced between the confronting foils in an interval from the leading end b to the trailing end of the primary shield foil 21 ($-\pi/2$ to $\pi$). A relative pulsed electromotive force $-3$ v is generated between the confronting foils in a following interval up to the trailing end of the secondary shield foil 22 ($-\pi$ to $-\pi/2$). The net result is that no relative difference between the pulsed electromotive forces induced by the confronting shield foils is produced throughout all of the electrostatic shield foils ($\frac{3}{4}\pi\times v-\frac{1}{4}\pi\times 3v=0$).

Figure 7:
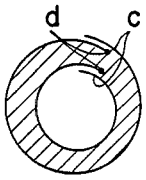
FIGS. 7 and 8 are cross-sectional views of shield foils according to still further embodiments of the invention.
Figure 8:
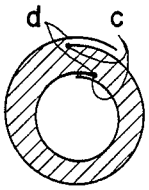

If the electrostatic shield foils are wound with their ends overlapping for a larger interval, then one of the overlapping foil ends which is closer to the insulator interposed between the foils is effective as an electrostatic shield between the primary and secondary windings. In examples shown in FIGS. 7 and 8, points c or points d (when foils are assumed to be wound in an opposite direction) are regarded as the leading ends.

Although certain preferred embodiments have been shown and described, it should be understood that many changes and modifications may be made therein without departing from the scope of the appended claims.

What is claimed is:

1. A pulse transformer for use in a switching power supply, comprising a common core, primary and secondary windings wound concentrically around said common core, one of said primary and secondary windings being disposed inwardly of the other, including another winding wound around the other winding and connected parallel to said one winding, a first pair of electrostatic shield foils interposed between said one winding and said other winding, a second pair of electrostatic shield foils interposed between said other winding and said another winding, and an insulator interposed between said electrostatic shield foils in each of said first and second pairs of foils, and connecting wires drawn from said electrostatic shield foils at points thereon where pulsed electromotive forces are induced which are of equal levels as seen from leading ends of the electrostatic shield foils.

* * * * *

UNITED STATES PATENT AND TRADEMARK OFFICE

CERTIFICATE OF CORRECTION

PATENT NO. : 4,518,941

DATED : May 21, 1985

INVENTOR(S) : Hajime Harada

It is certified that error appears in the above-identified patent and that said Letters Patent is hereby corrected as shown below:

Column 1, line 43, after "$C_2$", delete "$C_5$" and insert --$C_6$--.

Column 1, line 63, before "the shield", delete "bewteen" and insert --between--.

Column 4, line 9, after "without", delete "impairng" and insert --impairing--.

Column 4, line 29, after "radially", delete "alined" and insert --aligned--.

Signed and Sealed this

*Twentieth* Day of *August 1985*

[SEAL]

*Attest:*

DONALD J. QUIGG

*Attesting Officer*

*Acting Commissioner of Patents and Trademarks*